US006132535A

United States Patent [19]

Okada et al.

[11] Patent Number: 6,132,535

[45] Date of Patent: Oct. 17, 2000

[54] PROCESS FOR THE HEAT TREATMENT OF A NI-BASE HEAT-RESISTING ALLOY

[75] Inventors: Ikuo Okada; Taiji Torigoe; Hisataka Kawai; Koji Takahashi, all of Takasago; Itaru Tamura; Shyuichi Sakashita, both of Utsunomiya, all of Japan

[73] Assignees: Mitsubishi Heavy Industries, Ltd.; Mitsubishi Steel Mfg. Co., Ltd., both of Tokyo, Japan

[21] Appl. No.: 09/428,785

[22] Filed: Oct. 28, 1999

[51] Int. Cl.[7] ..... C22F 1/10; C22C 19/05

[52] U.S. Cl. ..... 148/677; 148/675; 420/447; 420/448; 420/449; 420/450; 420/451

[58] Field of Search ..... 148/677, 675; 420/447, 448, 449, 450, 451

[56] References Cited

U.S. PATENT DOCUMENTS

| | | | |
|---|---|---|---|
| 3,615,906 | 10/1971 | Vanwanderham et al. | 148/12.7 |
| 3,785,876 | 1/1974 | Bailey | 148/2 |
| 3,785,877 | 1/1974 | Bailey | 148/2 |
| 3,898,109 | 8/1975 | Shaw | 148/162 |
| 4,039,330 | 8/1977 | Shaw | 75/171 |
| 4,624,716 | 11/1986 | Noel et al. | 148/12.7 |
| 4,795,507 | 1/1989 | Nazmy | 148/11.5 |
| 4,810,467 | 3/1989 | Wood et al. | 420/448 |
| 5,131,961 | 7/1992 | Sato et al. | 148/677 |
| 5,328,659 | 7/1994 | Tillman et al. | 420/448 |
| 5,882,586 | 3/1999 | Tamura et al. | 148/410 |

FOREIGN PATENT DOCUMENTS

| | | |
|---|---|---|
| 0709477 | 1/1996 | European Pat. Off. . |
| 0937784 | 8/1999 | European Pat. Off. . |
| 54-6968 | 4/1979 | Japan . |
| 1-104738 | 4/1989 | Japan . |
| 08127833 | 5/1996 | Japan . |
| 8-127833 | 5/1996 | Japan . |

*Primary Examiner*—Daniel J. Jenkins
*Assistant Examiner*—Nicole Coy
*Attorney, Agent, or Firm*—Foley & Lardner

[57] ABSTRACT

Provided is a process for improving alloy properties which can improve the high-temperature ductility of a Ni-base heat-resisting alloy while maintaining its excellent high-temperature strength and weldability. Specifically, it relates to a process for the heat treatment of a Ni-base heat-resisting alloy having a specific composition which comprises the steps of subjecting the alloy to a first-stage solution treatment by keeping it at a specific temperature for a specific period of time; cooling the alloy to a second-stage solution treatment temperature at a specific cooling rate; subjecting the alloy to a second-stage solution treatment by keeping it at a specific temperature for a specific period of time; cooling the alloy rapidly to room temperature at a specific cooling rate; subjecting the alloy to a stabilizing treatment by keeping it at a specific temperature for a specific period of time; cooling the alloy rapidly to room temperature at a specific cooling rate; and subjecting the alloy to an aging treatment by keeping it at a specific temperature for a specific period of time.

2 Claims, 5 Drawing Sheets

PROCESS FOR THE HEAT TREATMENT OF A NI-BASE HEAT-RESISTING ALLOY

BACKGROUND OF THE INVENTION

1. Field of the Invention

This invention relates to a heat treatment process which can improve certain properties (in particular, ductility) of a Ni-base heat-resisting alloy used as a material for high-temperature components such as stationary blades of gas turbines.

2. Description of the Related Art

Ni-base heat-resisting alloys, which combine precipitation strengthening by γ' phase ($Ni_3(Al,Ti,Nb,Ta)$) with solid solution strengthening by Mo, W or the like, are being used for high-temperature components such as stationary blades of gas turbines. For these Ni-base heat-resisting alloys, attempts have been made to improve their properties such as high-temperature strength, corrosion resistance and weldability, by controlling the state of precipitation of γ' phase, for example, through adjustment of the proportions of constituent elements or through the addition of very small amounts of certain elements. Although such attempts are effective in improving the respective properties, it is difficult in the present situation to obtain a Ni-base heat-resisting alloy having a well-balanced overall combination of good properties.

When attention is paid to high-temperature strength and weldability among various properties, it is generally known that an increase in the amount of γ' phase precipitated causes an improvement in high-temperature strength, but tends to reduce weldability. For example, an alloy in which the amount of γ' phase precipitated is increased to improve high-temperature strength (Japanese Patent Publication (JP-B) No. 54-6968/'79) has poor weldability, and an alloy in which the amount of γ' phase precipitated is decreased to improve weldability (Japanese Patent Provisional Publication (JP-A) No. 1-104738/'89) shows a marked reduction in high-temperature strength.

As a Ni-base heat-resisting alloy having improved weldability without detracting from its high-temperature strength, the present inventors have previously developed and proposed a Ni-base heat-resisting alloy containing, on a weight percentage basis, 0.05 to 0.25% C, 18 to 25% Cr, 15 to 25% Co, 5 to 10% (W+1/2Mo) (provided that (W+1/2Mo) comprises one or both of 0 to 3.5% Mo and 5 to 10% W), 1 to 5% Ti, 1 to 4% Al, 0.5 to 4.5% Ta, 0.2 to 3% Nb, 0.005 to 0.1% Zr, and 0.001 to 0.01% B, the balance being Ni and incidental impurities, and having a composition defined by the fact that, on the graph of FIG. 1 plotting the weight percentage of (W+1/2Mo) as ordinate and the weight percentage of (Al+Ti) as abscissa, the (Al+Ti) content and the (W+1/2Mo) content fall within the range enclosed by the straight lines connecting point A [3% (Al+Ti), 10% (W+1/2Mo)], point B [5% (Al+Ti), 7.5% (W+1/2Mo)], point C [5% (Al+Ti), 5% (W+1/2Mo)], point D [7% (Al+Ti), 5% (W+1/2Mo)] and point E [7% (Al+Ti), 10% (W+1/2Mo)] in the order mentioned (Japanese Patent Provisional Publication (JP-A) No. 8-127833/'96). This Ni-base heat-resisting alloy will hereinafter be referred to as alloy A.

Although the above-described alloy A is a Ni-base heat-resisting alloy having excellent high-temperature strength and weldability, attention paid to high-temperature ductility reveals that the balance between high-temperature strength and high-temperature ductility is not satisfactory. When alloy A is subjected to a tension test, for example, at 850° C., it shows an elongation of as low as 5% or so because a fracture readily occurs at grain boundaries.

It is generally known that high-temperature ductility affects thermal cycle fatigue strength at elevated temperatures. Accordingly, it is desirable that components requiring excellent thermal cycle fatigue strength, such as stationary blades of gas turbines, show an elongation of not less than 8% in a tension test at 850° C.

SUMMARY OF THE INVENTION

In view of this actual state of the prior art, an object of the present invention is to provide a process for improving alloy properties which, when applied to the aforesaid alloy A, can improve its high-temperature ductility while maintaining its excellent high-temperature strength and weldability.

As a result of intensive investigation on the method of improving certain properties (in particular, ductility) of the aforesaid alloy A, the present inventors have found that the ductility of alloy A can be improved by subjecting it to a series of heat treatments including a two-stage solution treatment at predetermined temperatures. The present invention has been completed on the basis of this finding.

Specifically, the present invention relates to a process for the heat treatment of a Ni-base heat-resisting alloy identified as alloy A which comprises the steps of subjecting the alloy to a first-stage solution treatment by keeping it at a temperature of 1,160 to 1,225° C. for 1 to 4 hours; cooling the alloy to a second-stage solution treatment temperature of 1,000 to 1,080° C. at a cooling rate of 50 to 200° C. per hour; subjecting the alloy to a second-stage solution treatment by keeping it at that temperature for 0.5 to 4 hours; cooling the alloy rapidly to room temperature at a cooling rage of not less than 1,000° C. per hour; subjecting the alloy to a stabilizing treatment by keeping it at a temperature of 975 to 1,025° C. for 2 to 6 hours; cooling the alloy rapidly to room temperature at a cooling rage of not less than 1,000° C. per hour; and subjecting the alloy to an aging treatment by keeping it at a temperature of 800 to 900° C. for 4 to 24 hours.

After the alloy is subjected to the above-described heat treatments and then cooled to room temperature, the alloy may be subjected to an additional aging treatment by keeping it at a temperature of 675 to 725° C. for 10 to 20 hours, so that a further improvement in high-temperature properties can be achieved.

When the heat treatment process of the present invention is applied to alloy A, the grain boundaries of adjacent crystal grains are interdigitated to form a zigzag form as shown in FIGS. 3 and 4. Moreover, a sufficient amount of γ' phase is precipitated within crystal grains in a uniformly and finely dispersed form. Thus, not only the strength within crystal grains but also the bonding strength between crystal grains (i.e., the strength of grain boundaries) can be improved to impart excellent high-temperature strength and ductility to alloy A. With special regard to elongation, alloy A shows a tensile elongation of not less than 8% at 850° C., so that satisfactorily high thermal fatigue strength can be obtained.

BRIEF DESCRIPTION OF THE INVENTION

DETAILED DESCRIPTION OF PREFERRED EMBODIMENTS

Alloy A which can be heat-treated according to the present invention is the Ni-base heat-treating alloy which has been proposed in Japanese Patent Provisional Publication (JP-A) No. 8-127833/'96 and falls within the above-described compositional range.

Figure 5:
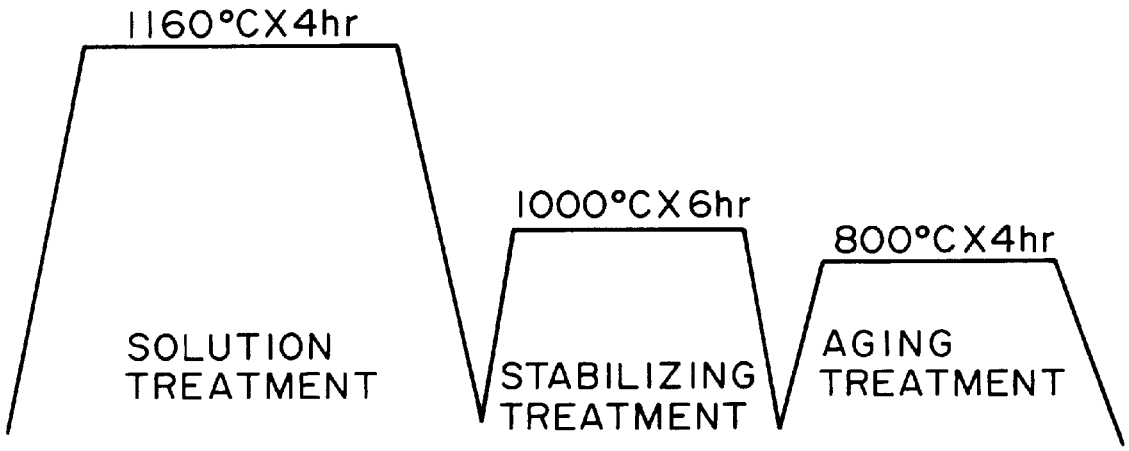
FIG. 5 PRIOR ART
FIG. 5 is a schematic diagram showing an exemplary pattern of the heat-treating conditions employed in a conventional process.

As described in Japanese Patent Provisional Publication (JP-A) No. 8-127833/'96, this alloy has been heat-treated according to a conventional process which comprises a solution treatment, a stabilizing treatment and an aging treatment as represented by the pattern shown in FIG. 5.

The heat treatment process of the present invention also comprises a series of heat treatments including a solution treatment, a stabilizing treatment and an aging treatment. However, in contrast to the conventional process in which the solution treatment is carried out in one stage, the heat treatment process of the present invention is characterized in that the solution treatment is carried out in two stages as represented by the pattern shown in FIG. 2(*a*).

More specifically, in the first-stage solution treatment of the heat treatment process of the present invention, an alloy material to be heat-treated is kept at a temperature of 1,160 to 1,225° C. for 1 to 4 hours. The purpose of this first-stage heating is to bring various phases of this alloy, except primary carbides, temporarily into solid solution and thereby create a homogeneous structure. The aforesaid temperature range has been determined as a temperature range which is sufficiently high to bring various precipitates (e.g., γ' phase) formed during the solidification of a molten material temporarily into solid solution, but does not cause initial (partial) melting, with due regard paid to the accuracy of temperature control in the heating furnace. The heating time of 1 to 4 hours has been determined so as to be necessary and sufficient for the homogenization of the structure, with further consideration for economy.

Next, after the alloy material is cooled from the first-stage solution treatment temperature to a second-stage solution treatment temperature of 1,000 to 1,080° C. at a cooling rate of 50 to 200° C. per hour, a second-stage solution treatment is carried out by keeping the alloy material at that temperature for 0.5 to 4 hours. The cooling rate from the first-stage to the second-stage heat-treating temperature and the second-stage heating temperature and time have been determined so as to create zigzag grain boundaries indispensable for the purpose of imparting excellent high-temperature strength and ductility and so as to cause the precipitation of γ' phase. Specifically, the cooling rate has been determined to be not greater than 200° C. per hour. Moreover, since an unduly low cooling rate may extend the heating time and cause an increase in cost, the minimum cooling rate has been determined to be 50° C. per hour.

The second-stage heating temperature range of 1,000 to 1,080° C. has been determined as a temperature range which promotes and completes the creation of zigzag grain boundaries, but does not bring γ' phase into solid solution, with due regard paid to the accuracy of temperature control in the heating furnace. The heating time of 0.5 to 4 hours has been determined so as to be necessary and sufficient for the purpose of promoting and completing the creation of the desired form of grain boundaries, with further consideration for economy. The maximum heating time of 4 hours has been chosen in order to avoid an increase in cost. Another reason is that, if the alloy material is heated for a time longer than 4 hours, a coarsening of γ' phase may result.

After heating, the alloy material is forcedly and rapidly cooled to room temperature at a cooling rate of not less than 1,000° C. per hour in Ar gas, $N_2$ gas or air.

The expression "the creation of zigzag grain boundaries" as used herein means a phenomenon in which, as will be described later with reference to FIGS. 3 and 4, the local precipitation and growth of γ' phase at or near grain boundaries causes the grain boundaries to move into the adjoining crystal grains, penetrate alternately into both crystal grains, and assume a tortuous form.

Next, the alloy material having undergone the two-stage solution treatment is subjected to a stabilizing treatment by keeping it at a temperature of 975 to 1,025° C. for 2 to 6 hours. In this stabilizing treatment, the heating temperature range of 975 to 1,025° C. has been determined so as to regulate the size and form of γ' phase properly and thereby achieve excellent high-temperature strength and ductility, with due regard paid to the accuracy of temperature control in the heating furnace. The heating time of 2 to 6 hours has been determined so as to be necessary and sufficient for the purpose of developing the desired form of γ' phase, with consideration for economy. After the stabilizing treatment, the alloy material is forcedly and rapidly cooled to room temperature at a cooling rate of not less than 1,000° C. per hour in Ar gas, $N_2$ gas or air so that the desired form may be given to the γ' phase serving as a strengthening phase.

As the final step of the heat treatment, the alloy material having undergone the stabilizing treatment is subjected to an aging treatment by keeping it at a temperature of 800 to 900° C. for 4 to 24 hours. This aging treatment is a step carried out in order to further precipitate γ' phase in a uniformly and finely dispersed form and thereby achieve excellent high-temperature strength.

After being heated in the aging treatment, the alloy material is forcedly and rapidly cooled to room temperature at a cooling rate of not less than 1000° C. per hour in Ar gas, $N_2$ gas or air.

Figure 1:
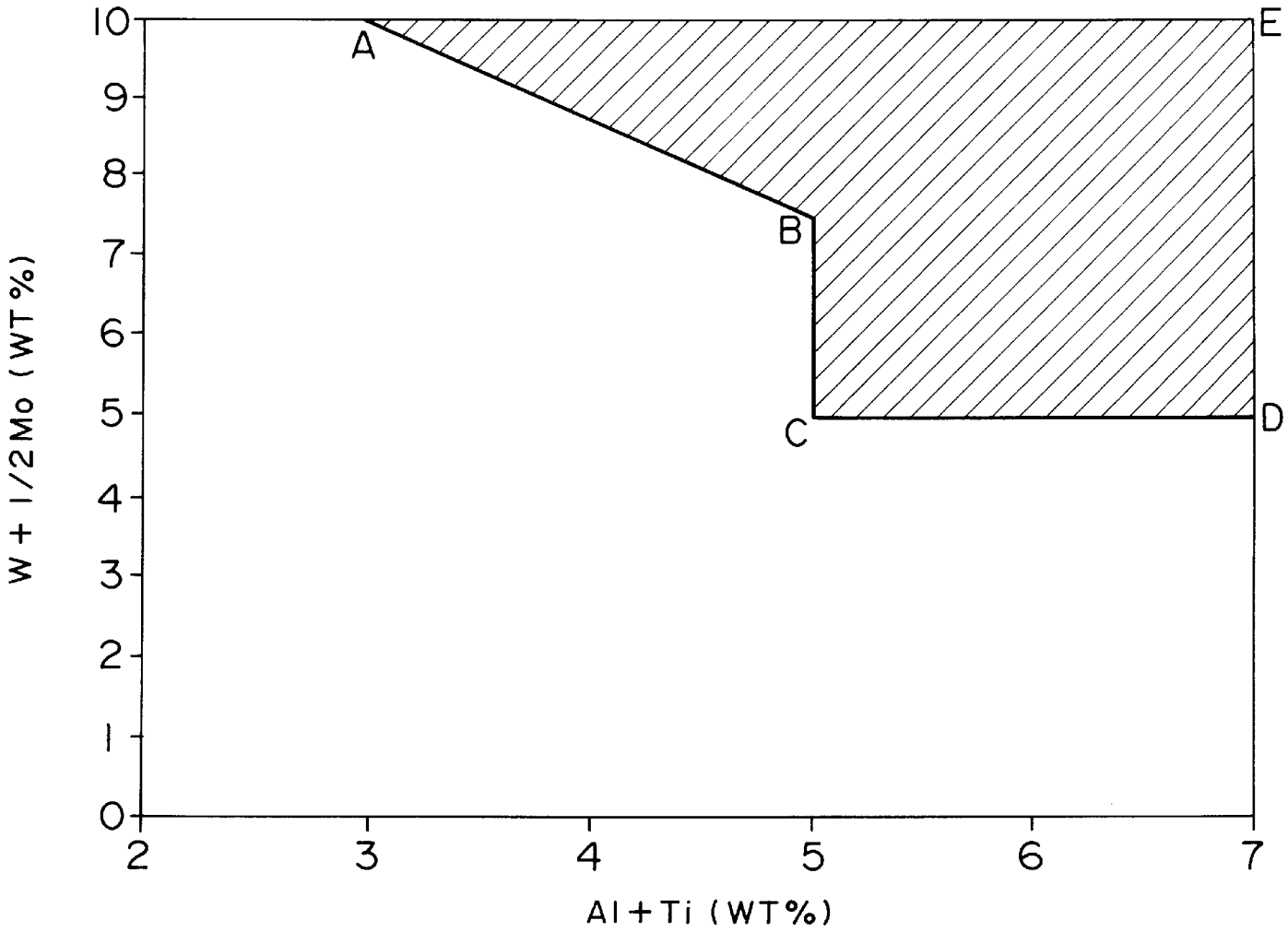
FIG. 1 is a diagram showing the compositional range of the Ni-base heat-resisting alloy which can be heat-treated according to the present invention.
Figure 2A:
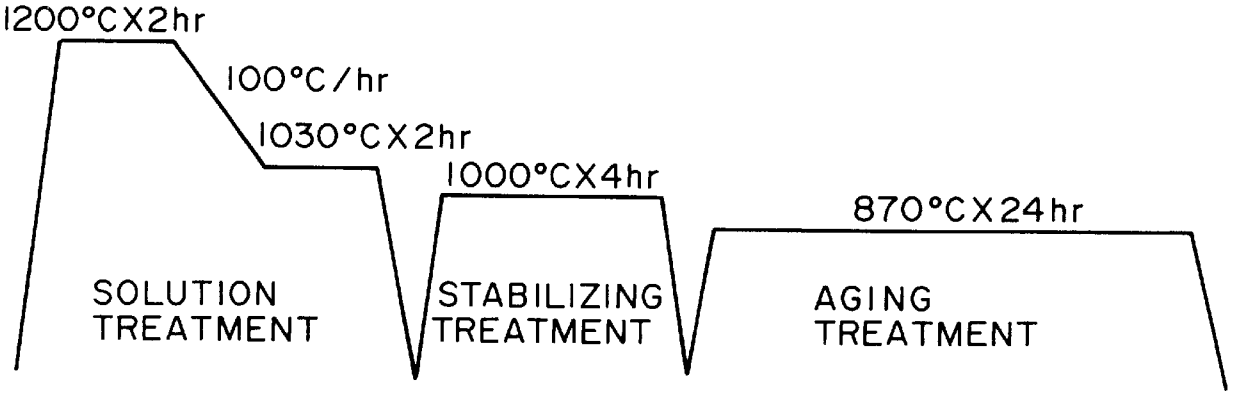
FIG. 2 is a schematic diagram showing exemplary patterns of the heat-treating conditions employed in the process of the present invention.
Figure 2B:
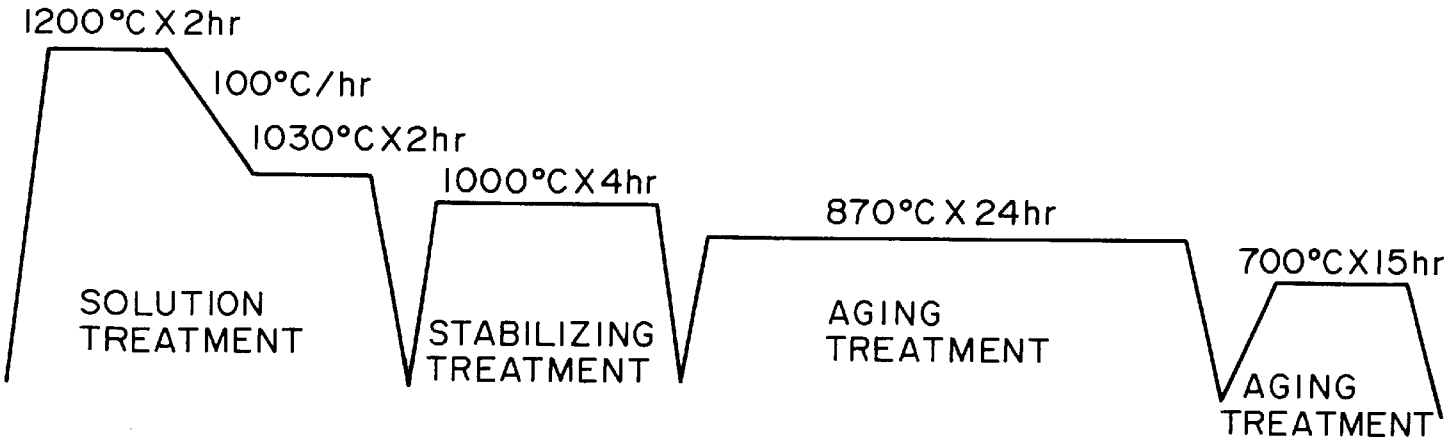

If necessary, the high-temperature strength of the alloy material may further be improved by subjecting it to an additional aging treatment, i.e., by heating it at a temperature of 675 to 725° C. for 10 to 20 hours as shown in FIG. 2(*a*). The heating at the temperature of 675 to 725° C. for 10 to 20 hours has been determined so as to further promote the precipitation of finely dispersed γ' phase, with due regard paid to the accuracy of temperature control in the heating furnace.

The process of the present invention is further illustrated by the following examples.

EXAMPLES

A primary molten material having a composition consisting of, on a weight percentage basis, 19% Cr, 19% Co, 6%

W, 1.4% Ta, 1% Nb, 3.7% Ti, 1.9% Al, 0.17% C, 0.02% Zr, 0.005% B, and the balance being Ni and incidental impurities, which corresponds to the average composition of alloy A, was prepared. According to a precision casting technique based on the lost wax process, this material was formed into round bars having a diameter of 15 mm and a length of 100 mm.

These round bars were separately heat-treated under various common heat-treating conditions of the prior art comprising a one-stage solution treatment, a stabilizing treatment and an aging treatment, and under various heat-treating conditions of the present invention comprising a two-stage solution treatment, a stabilizing treatment and an aging treatment. Tension test specimens (having a diameter of 6.25 mm and a length of 25 mm in the parallel part) were prepared from the heat-treated materials and subjected to tension tests at 850° C. The heat-treating conditions employed for each sample and the results of tension tests are shown in Table 1.

It was confirmed by the results shown in Table 1 that all 20 of the samples heat-treated according to the process of the present invention (i.e., sample Nos. 1–11) had the desired high-temperature strength (i.e., a tensile strength of not less than 60 kg/mm$^2$) and ductility (i.e., an elongation of not less than 8%).

Figure 3:
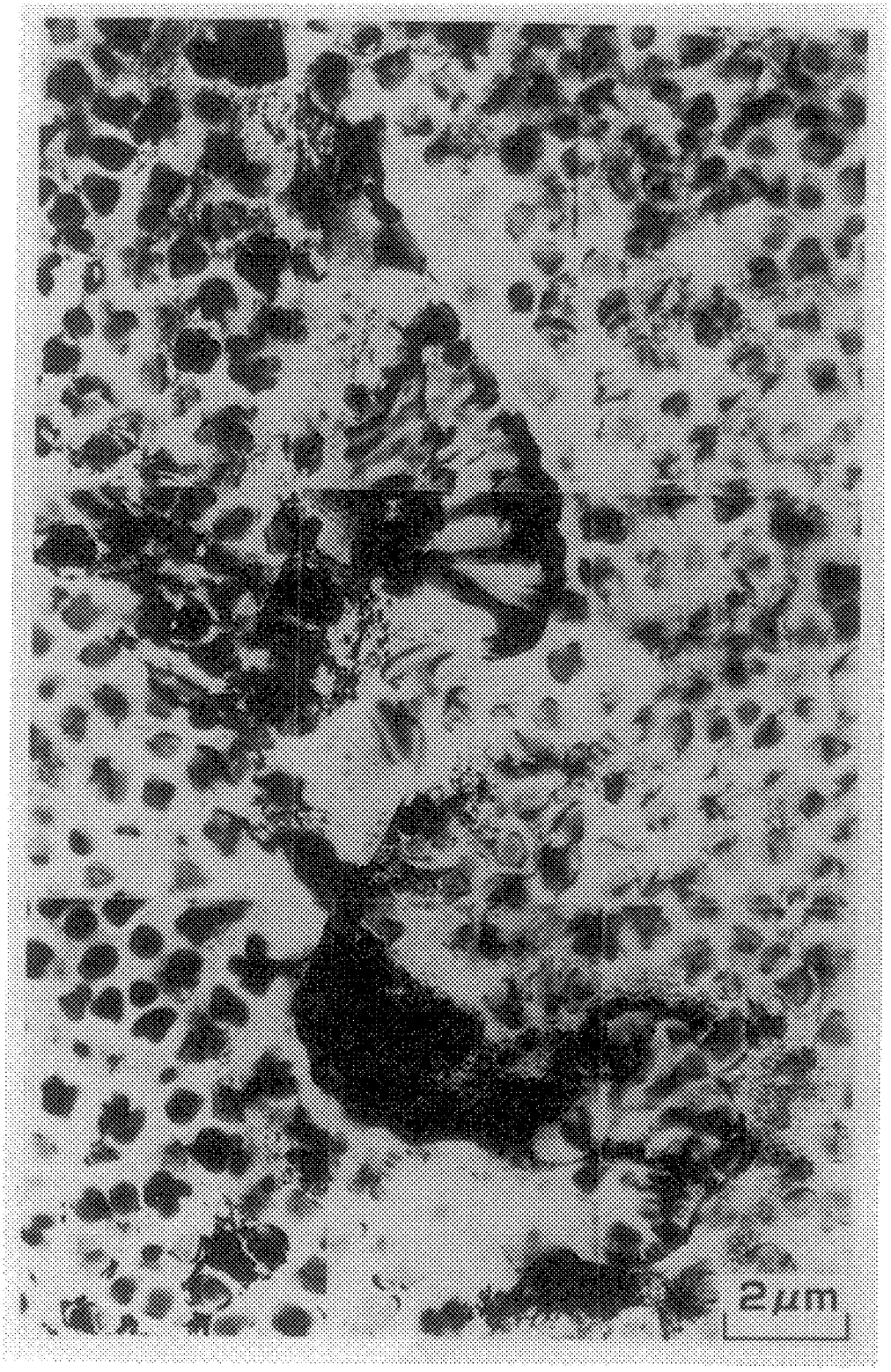
FIG. 3 is a photomicrograph showing the microstructure of an exemplary material heat-treated according to the process of the present invention.
Figure 4:
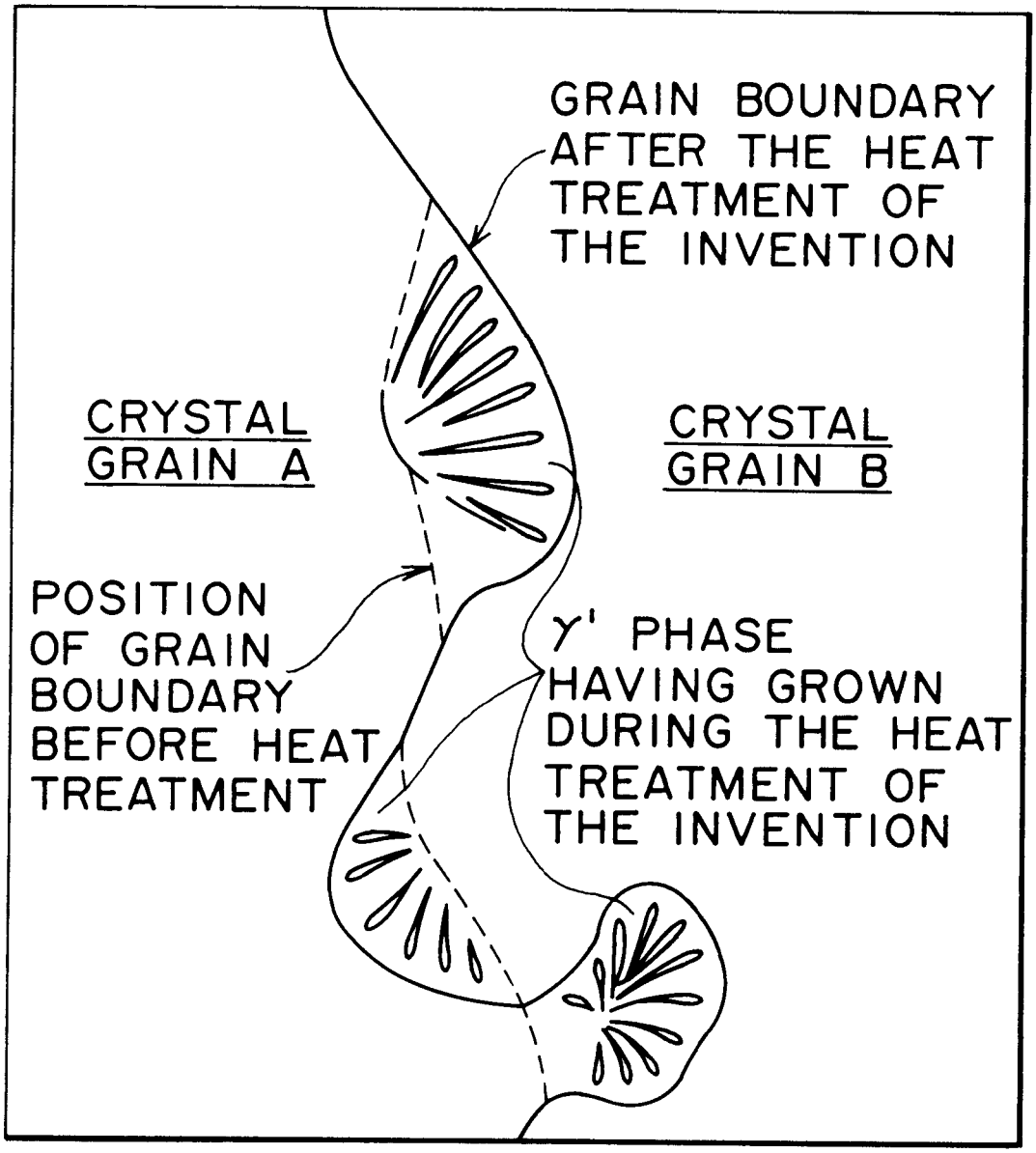
FIG. 4 is a schematic illustration of the photomicrograph of FIG. 3.

Moreover, a photomicrograph showing the microstructure of the heat-treated material identified as sample No. 3 in Table is given in FIG. 3, and a schematic illustration of the photomicrograph of FIG. 3 is given in FIG. 4. It can be seen from FIGS. 3 and 4 that, in the material heat-treated according to the process of the present invention, the grain boundaries were made zigzag to an advanced degree.

TABLE 1

Heat-treating Conditions and Tensile Properties after Treatment

| Division | Treat material No. | Heat-treating conditions: Solution treatment (≠1) | Stabilizing treatment | Aging treatment | Tensile properties (850° C.): Tensile strength (kg/mm$^2$) | Elongation (%) |
|---|---|---|---|---|---|---|
| Heat treatment of the Invention | 1 | 1200° C./2 h→(100° C./h)→1000° C./2 h | 1000° C./4 h | 870° C./24 h | 60.3 | 11.8 |
| | 2 | 1200° C./2 h→(100° C./h)→1030° C./2 h | 1000° C./4 h | 800° C./24 h | 65.6 | 11.2 |
| | 3 | 1200° C./2 h→(100° C./h)→1030° C./1 h | 1000° C./4 h | 870° C./24 h | 62.3 | 13.1 |
| | 4 | 1200° C./2 h→(100° C./h)→1030° C./2 h | 1000° C./4 h | 870° C./24 h | 64.3 | 17.6 |
| | 5 | 1200° C./2 h→(200° C./h)→1030° C./2 h | 1000° C./4 h | 870° C./24 h | 65.1 | 12.3 |
| | 6 | 1200° C./2 h→(100° C./h)→1030° C./2 h | 1000° C./4 h | 900° C./24 h + 700° C./16 h | 61.5 | 17.8 |
| | 7 | 1200° C./2 h→(100° C./h)→1080° C./1 h | 1000° C./4 h | 870° C./24 h | 62.3 | 10.5 |
| | 8 | 1180° C./2 h→(100° C./h)→1060° C./2 h | 1000° C./6 h | 870° C./24 h | 62.5 | 10.8 |
| | 9 | 1180° C./2 h→(200° C./h)→1060° C./2 h | 1000° C./6 h | 870° C./24 h | 63.1 | 10.0 |
| | 10 | 1160° C./2 h→(50° C./h)→1060° C./1 h | 1000° C./4 h | 870° C./24 h | 60.5 | 14.4 |
| | 11 | 1160° C./2 h→(100° C./h)→1060° C./1 h | 1000° C./4 h | 870° C./24 h | 60.4 | 13.6 |
| Conventional heat treatment | Control 1 | 1160° C./4 h | 1000° C./6 h | 800° C./4 h | 74.9 | 5.3 |
| | Control 2 | 1160° C./4 h | 1000° C./6 h | 900° C./24 h + 700° C./16 h | 63.2 | 5.7 |
| | Control 3 | 1200° C./2 h | 1030° C./2 h + 1000° C./4 h | 870° C./24 h | 64.4 | 5.0 |

(≠1) The values in parentheses indicate cooling rates. The cooling rates after the solution treatment and the stabilizing treatment were both about 1,500° C. per hour.

What is claimed is:

1. A process for the heat treatment of a Ni-base heat-resisting alloy which contains, on a weight percentage basis, 0.05 to 0.25% C, 18 to 25% Cr. 15 to 25% Co, 5 to 10% (W+1/2Mo) (provided that (W+1/2Mo) comprises one or both of 0 to 3.5% Mo and 5 to 10% W), 1 to 5% Ti, 1 to 4% Al, 0.5 to 4.5% Ta, 0.2 to 3% Nb, 0.005 to 0.1% Zr and 0.001 to 0.01% B, the balance being Ni and incidental impurities, and which has a composition defined by the fact that, on a graph plotting the weight percentage of (W+1/2Mo) as ordinate and the weight percentage of (Al+Ti) as abscissa, the (Al+Ti) content and the (W+1/2Mo) content fall within the range enclosed by the straight lines connecting point A (3% (Al+Ti), 10% (W+1/2Mo)), point B (5% (Al+Ti), 7.5% (W+1/2Mo)), point C (5% (Al+Ti), 5% (W+1/2Mo)), point D (7% (Al+Ti), 5% (W+1/2Mo)) and point E (7% (Al+Ti), 10% (W+1/2Mo)) in the order mentioned, the process comprising the steps of subjecting the alloy to a first-stage solution treatment by keeping it at a temperature of 1,160 to 1,225° C. for 1 to 4 hours; cooling the alloy to a second-stage solution treatment temperature of 1,000 to 1,080° C. at a cooling rate of 50 to 200° C. per hour; subjecting the alloy to a second-stage solution treatment by keeping it at that temperature for 0.5 to 4 hours; cooling the alloy rapidly to room temperature at a cooling rate of not less than 1,000° C. per hour; subjecting the alloy to a stabilizing treatment by keeping it at a temperature of 975 to 1,025° C. for 2 to 6 hours; cooling the alloy rapidly to room temperature at a cooling rate of not less than 1,000° C. per hour; and subjecting the alloy to an aging treatment by keeping it at a temperature of 800 to 900° C. for 4 to 24 hours.

2. A process for the heat treatment of a Ni-base heat-resisting alloy as claimed in claim 1 which further comprises the steps of cooling the alloy to room temperature and subjecting the alloy to an additional aging treatment by keeping it at a temperature of 675 to 725° C. for 10 to 20 hours.

* * * * *